US005749771A

United States Patent [19]

Isobe

[11] Patent Number: 5,749,771

[45] Date of Patent: May 12, 1998

[54] POLISHING APPARATUS FOR FINISHING SEMICONDUCTOR WAFER AT HIGH POLISHING RATE UNDER ECONOMICAL RUNNING COST

[75] Inventor: Akira Isobe, Tokyo, Japan

[73] Assignee: NEC Corporation, Tokyo, Japan

[21] Appl. No.: 394,169

[22] Filed: Feb. 22, 1995

[30] Foreign Application Priority Data

Feb. 22, 1994 [JP] Japan ..... 6-049769

[51] Int. Cl.[6] ..... B24B 29/00

[52] U.S. Cl. ..... 451/41; 451/56; 451/285; 451/287; 451/443; 451/444

[58] Field of Search ..... 451/41, 57, 56, 451/283, 285, 286, 287, 443, 444, 36, 397, 398, 402

[56] References Cited

U.S. PATENT DOCUMENTS

| | | | |
|---|---|---|---|
| 2,826,009 | 3/1958 | Shurson | 451/286 |
| 2,979,868 | 4/1961 | Emeis | 451/286 |
| 3,374,582 | 3/1968 | Boettcher | 451/286 |
| 3,377,750 | 4/1968 | Day | 451/286 |
| 3,568,371 | 3/1971 | Day et al. | 451/286 |
| 3,841,031 | 10/1974 | Walsh | 451/41 |
| 4,850,157 | 7/1989 | Holmstrand | 51/128 |
| 4,879,258 | 11/1989 | Fisher | 451/285 |
| 5,032,203 | 7/1991 | Doy et al. | 156/345 |
| 5,113,622 | 5/1992 | Nishiguchi et al. | 451/285 |
| 5,216,842 | 6/1993 | Breivogel et al. | 451/285 |

*Primary Examiner*—Eileen Morgan

*Attorney, Agent, or Firm*—Sughrue, Mion, Zinn, Macpeak & Seas, PLLC

[57] ABSTRACT

A polishing apparatus is equipped with a wafer holder and a pad conditioner concurrently changed to working position over a polishing pad, and the polishing pad grinds the semiconductor wafer under concurrent cleaning operation thereon so as to enhance the throughput of the polishing apparatus: grooves are formed in a wafer carrier of the wafer holder for sufficiently supplying polishing slurry to the semiconductor wafer, and a guide wall is provided over the polishing pad so as to cause the polishing slurry to partly return to a central area of the polishing pad.

18 Claims, 12 Drawing Sheets

POLISHING APPARATUS FOR FINISHING SEMICONDUCTOR WAFER AT HIGH POLISHING RATE UNDER ECONOMICAL RUNNING COST

FIELD OF THE INVENTION

This invention relates to a polishing apparatus for a semiconductor wafer and, more particularly, to a polishing apparatus for finishing a semiconductor wafer at high polishing rate under economical running cost.

DESCRIPTION OF THE RELATED ART

While semiconductor integrated circuits are being fabricated on a semiconductor wafer, wiring strips and inter-level insulating layers are alternately laminated over the semiconductor wafer, and the valleys between the wiring strips are transferred to the upper inter-level insulating layer. FIG. 1A illustrates a part of an integrated circuit device fabricated on a semiconductor wafer 1, and wiring strips 2*a* and 2*b* are sandwiched between a lower inter-level insulating layer 3*a* and an upper inter-level insulating layer 3*b*. The upper inter-level insulating layer may be formed of oxide deposited over the entire surface through a plasma-assisted chemical vapor deposition.

Even though the lower inter-level insulating layer 3*a* has a flat upper surface, the upper inter-level insulating layer 3*b* partially protrudes due to the wiring strips 2*a* and 2*b*, and a valley 4 between the wiring strips 2*a* and 2*b* is transferred to the upper inter-level insulating layer 3*b*. The upper inter-level insulating layer 3*b* is subjected to a polishing so as to create a smooth top surface as shown in FIG. 1B.

FIGS. 2 and 3 illustrates a typical example of the polishing apparatus, and comprises a frame work 5*a* with a circular aperture, a disk-shaped rotatable table 5*b* exposed to the circular aperture, a rotational mechanism 5*c* connected to the rotatable table 5*b*, a polishing pad 5*d* made of urethane foam and covering the upper surface of the rotatable table 5*b*, a wafer holder 5*e*, a pad conditioner 5*f* and a slurry supplying system 5*g* provided over the polishing pad 5*d*.

The wafer holder 5*e* is changeable between a rest position and a working position, and has an arm member 5*h* turnable with respect to the frame work 5*a* and a wafer carrier 5*i* rotatably supporting a semiconductor wafer 6. The multi-level structure 2*a*/2*b* and 3*a*/3*b* laminated on the semiconductor wafer 1 is simply referred to as "semiconductor wafer" in the following description.

While the wafer holder 5*e* is staying in the rest position, the wafer carrier 5*i* is resting over the frame work 5*a*, and an operator can change the semiconductor wafer to a new one. On the other hand, when the arm member 5*h* transfers the wafer carrier 5*i* to the working position, the wafer carrier 5*i* presses the semiconductor wafer 6 against the polishing pad 5*d* as shown in FIGS. 2 and 3, and rotates the semiconductor wafer thereon.

The carrier 5*i* is illustrated in detail in FIG. 4, and has a rotatable base plate 5*j*, a retainer ring 5*k* detachable to the rotatable base plate 5*j* and a pad 5*m*. A circular opening 5*n* is formed in the retainer ring 5*k* (see FIG. 5), and the semiconductor wafer 6 is pressed against the pad 5*m* by the retainer ring 5*k*. The retainer ring 5*k* is thinner than the semiconductor wafer 6, and the semiconductor wafer 6 projects from the circular opening 5*n* by a third of the thickness thereof.

Turning back to FIGS. 2 and 3, the pad conditioner 5*f* is also shiftable between a rest position and a working position, and has an arm member 5*o* turnable with respect to the frame work 5 *a*, a disk member 5*p* rotatable with respect to the arm member 5*o* and a diamond pellet 5*q* attached to the disk member 5*p* by means of magnetic force. A wire brush is available instead of the diamond pellet 5*p*. While the pad conditioner 5*f* is staying in the rest position, the diamond pellet 5*p* is out of the space over the polishing pad 5*d* as shown in FIGS. 2 and 3, and is replaceable with a new pellet. When the arm member 5*o* turns to the working position, the diamond pellet 5*q* is pressed against the polishing pad 5*d*, and is rotated on the polishing pad 5*d* so as to recover the polishing pad 5*d* from loading.

The wafer holder 5*e* and the pad conditioner 5*f* alternately enter into the working position. Namely, the wafer holder 5*e* firstly enters into the working position, and the pad conditioner 5*f* remains in the rest position. The prior art polishing apparatus is ready for operation as shown in FIGS. 2 and 3. While the rotational mechanism 5*c* is rotating the rotatable table 5*b* and, accordingly, the polishing pad 5*d*, the semiconductor wafer 6 is pressed against the polishing pad 5*d*, and is rotated on the polishing pad 5*d*. The slurry supply system 5*g* is continuously supplying polishing slurry to the polishing pad 5*d*, and the surface of the semiconductor wafer 6 is grinded as shown in FIG. 1*b*. The centrifugal force due to the rotation of the rotatable table 5*b* is exerted to the polishing slurry, and the polishing slurry flows out from the outer periphery of the polishing pad 5*d*.

Upon completion of the polishing work on the semiconductor wafer 6, the wafer holder 5*e* is changed to the rest position, and the pad conditioner 5*f* enters into the working position as shown in FIGS. 6 and 7. While an operator is changing the polished semiconductor wafer 6 to a new wafer, the diamond pellet 5*q* is pressed against the polishing pad 5*d*, and is rotated on the polishing pad 5*d*. The diamond pellet 5*q* removes the powder loaded into the polishing pad 5*d* in the polishing work, and recovers the polishing pad 5*d* from loading.

After the recovery from the loading, the pad conditioner 5*f* is alternated by the wafer holder 5*e*, and the polishing apparatus restarts the polishing work on the new semiconductor wafer.

Thus, the prior art polishing apparatus alternately puts the wafer holder 5*e* and the pad conditioner 5*f* into the working position, and intermittently carries out the polishing work on the semiconductor wafer 6.

The first problem inherent in the prior art polishing apparatus is a low throughput. This is because of the fact that the prior art polishing apparatus periodically has to refresh the polishing pad 5*d*. While the polishing pad 5*d* is removing the powder, the wafer holder 5*e* stands idle, and the recovery work deteriorates the throughput of the prior art polishing apparatus. In order to enhance the throughput, it may be considered to increase the polishing rate by increasing the pressure exerted on the semiconductor wafer 6 against the polishing pad 5*d* or the rotating speed. However, when the polishing rate is increased over a critical level, the polished surface is warped, and the increase of polishing rate is not preferable. Another possible solution may be a parallelization. Namely, if a plurality of semiconductor wafers 6 are simultaneously polished on the polishing pad 5*d*, the throughput is expected to be enhanced. However, the simultaneous treatment supplies much powder to the polishing pad 5*d*, and the loaded polishing pad 5*d* decreases the polishing rate. As shown in FIG. 8, when only one semiconductor wafer 6 is polished on the polishing pad 5*d*, the decrement is plotted on line A. If the semiconductor wafers 6 are increased to 2 and 5, the decrement is decreased as indicated by Plots B and Plots C, respectively. Thus, the simultaneous treatment requires frequent conditioning work on the polishing pad 5d, and is not a drastic solution.

The second problem inherent in the prior art polishing apparatus is poor polishing uniformity within wafer. In detail, while the semiconductor wafer 6 is being subjected to the polishing on the polishing pad 5d, the retainer ring 5k presses the semiconductor wafer 5i against the polishing pad 5d, and the retainer ring 5k tends to be held in contact with the polishing pad 5d without a gap. The retainer ring 5k impedes the supply of the polishing slurry to the semiconductor wafer 6, and the polishing pad 5d hardly achieves uniform polishing. In fact, a 6-inch semiconductor wafer 6 projects from the retainer ring 5k by only about 200 microns. If the projection is increased, the retainer ring 5k is spaced from the polishing pad 5d, and the polishing slurry is easily supplied to the semiconductor wafer 6, and the polishing uniformity is expected to be improved. However, if the semiconductor wafer 6 widely projects from the retainer ring 5k, the semiconductor wafer 6 is liable to be moved due to the friction against the polishing pad 5d, and the retainer ring 5k can not stably support the semiconductor wafer 6. Moreover, if the projection is increased by decreasing the thickness of the retainer ring 5k, the retainer ring 5k is liable to be deformed and broken. For this reason, the projection of the semiconductor wafer 6 is regulated to about 200 microns, and the second problem is not solved by increasing the projection.

The prior art polishing apparatus further encounters the third problem in the running cost due to large consumption of the polishing slurry. The prior art polishing apparatus consumes 200 milliliter per minute, and the polishing slurry of 1 liter is consumed in the polishing work on each semiconductor wafer 6. In order to keep the polishing slurry on the polishing pad 5d, a guard wall 7 may be provided on the rotatable table 5b along the outer periphery of the polishing pad 5d as shown in FIG. 9. The guard wall 7 does not allow the polishing slurry to flow out, and the slurry consumption is minimized. However, the polishing slurry on the polishing pad 5d is exposed to the grinded powder over the polishing work, and is polluted. This results in that the polishing rate is gradually decreased, and the decrement is hardly controlled with time.

SUMMARY OF THE INVENTION

It is therefore an important object of the present invention to provide a polishing apparatus which has a large throughput.

It is another important object of the present invention to provide a polishing apparatus which achieves an improved polishing uniformity.

It is yet another important object of the present invention to provide a polishing apparatus which decreases the running cost.

To accomplish the first object, the present invention proposes to remove grinded powder from a polishing powder during a polishing work.

To accomplish the second object, the present invention proposes to guide polishing slurry to the inside of a retainer.

To accomplish the third object, the present invention proposes to control the amount of polishing slurry flowing out from a polishing pad.

In accordance with one aspect of the present invention, there is provided a polishing apparatus for grinding a semiconductor wafer, comprising: a table driven for rotation; a polishing pad provided on a surface of the table that rotates together with the table; a slurry supplying system provided over the polishing pad for supplying a polishing slurry thereto; a wafer holder system retaining at least one semiconductor wafer for pressing a surface of the at least one semiconductor wafer against the polishing pad; and a pad conditioning system operative to clean the polishing pad while the at least one semiconductor wafer is being polished on the polishing pad.

In accordance with another aspect of the present invention, there is provided a polishing apparatus for grinding a semiconductor wafer, comprising: a table driven for rotation; a polishing pad provided on a surface of the table that rotates together with the table; a slurry supplying system provided over the polishing pad for supplying a polishing slurry thereto; and a wafer holder system pressing a surface of at least one semiconductor wafer against the polishing pad, the wafer holder having a carrier block and a retainer ring attached to the carrier block for retaining the at least one semiconductor wafer therebetween, the surface of the at least one semiconductor wafer projecting from an opening of the retainer ring, at least one groove being formed in the retainer ring so as to supply the polishing slurry through the groove to the surface of the at least one semiconductor wafer.

In accordance with yet another aspect of the present invention, there is provided a polishing apparatus for grinding a semiconductor wafer, comprising: a table driven for rotation; a polishing pad provided on a surface of the table that rotates together with the table; a slurry supplying system provided over the polishing pad for supplying a polishing slurry thereto; a wafer holder system retaining at least one semiconductor wafer for pressing a surface of the at least one semiconductor wafer against the polishing pad; and a guide member stationary with respect to the table and held in contact with the polishing pad for forcing a part of the polishing slurry to return from an outer periphery of the polishing pad to a center area of the polishing pad.

BRIEF DESCRIPTION OF THE DRAWINGS

The features and advantages of the polishing apparatus according to the present invention will be more clearly understood from the following description taken in conjunction with the accompanying drawings in which.

DESCRIPTION OF THE PREFERRED EMBODIMENTS

First Embodiment

Figure 1A:
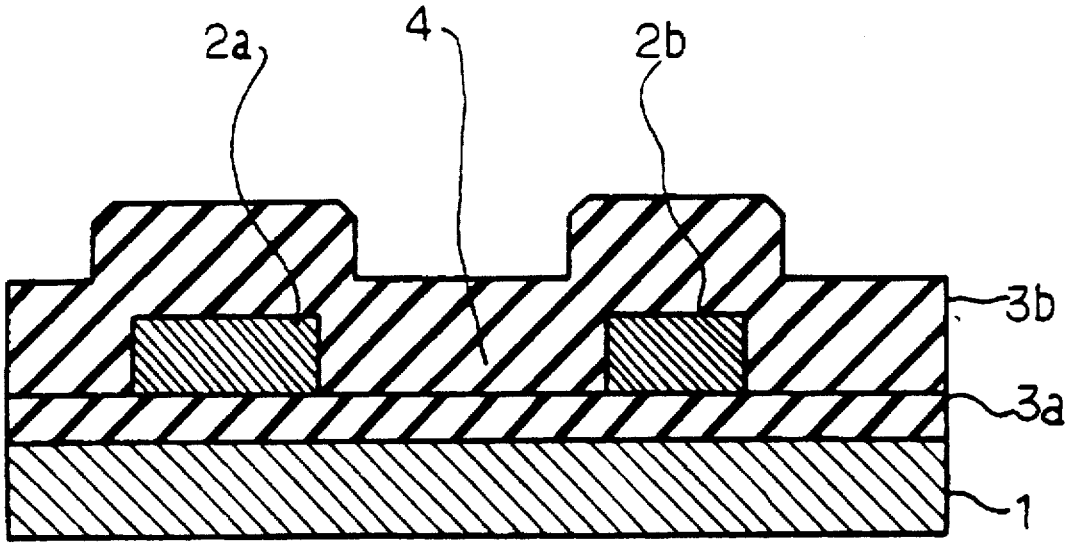
Fig. 1A PRIOR ART
FIG. 1A is a cross sectional view showing the laminated structure on the semiconductor wafer before the polishing stage.
Figure 1B:
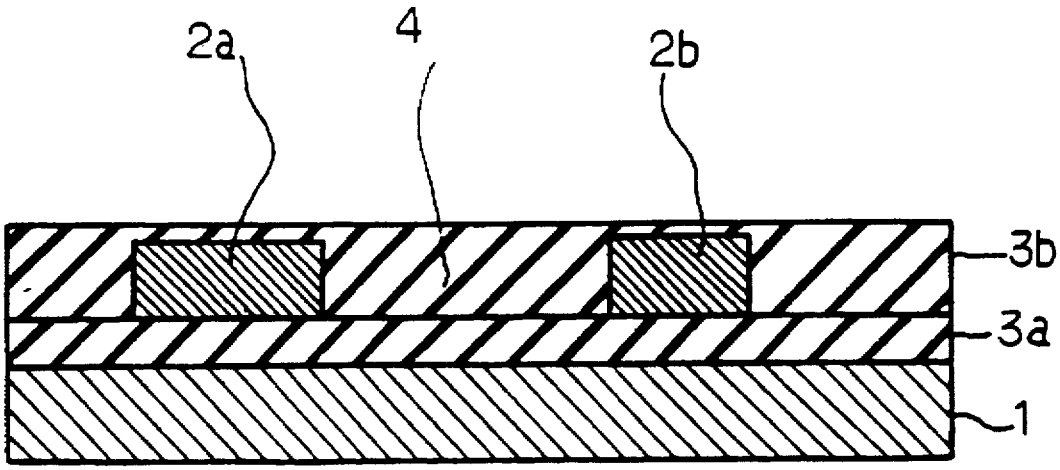
Fig. 1B PRIOR ART
FIG. 1B is a cross sectional view showing the laminated structure on the semiconductor wafer subjected to the polishing.
Figure 2:
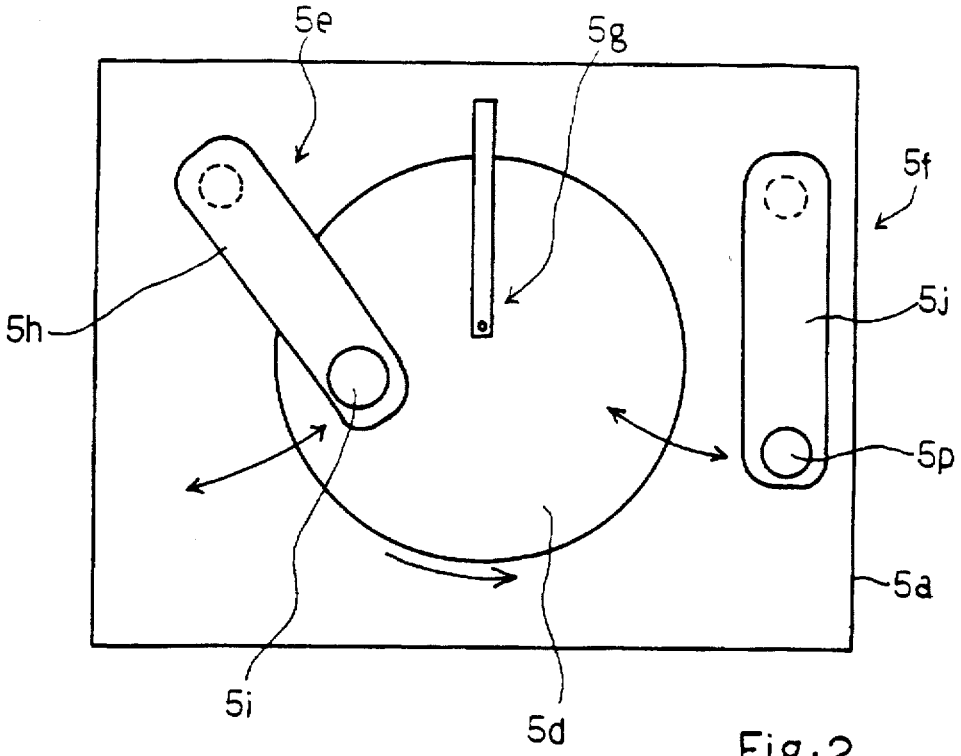
Fig. 2 PRIOR ART
FIG. 2 is a plan view showing the arrangement of the prior art polishing apparatus in a polishing work.
Figure 3:
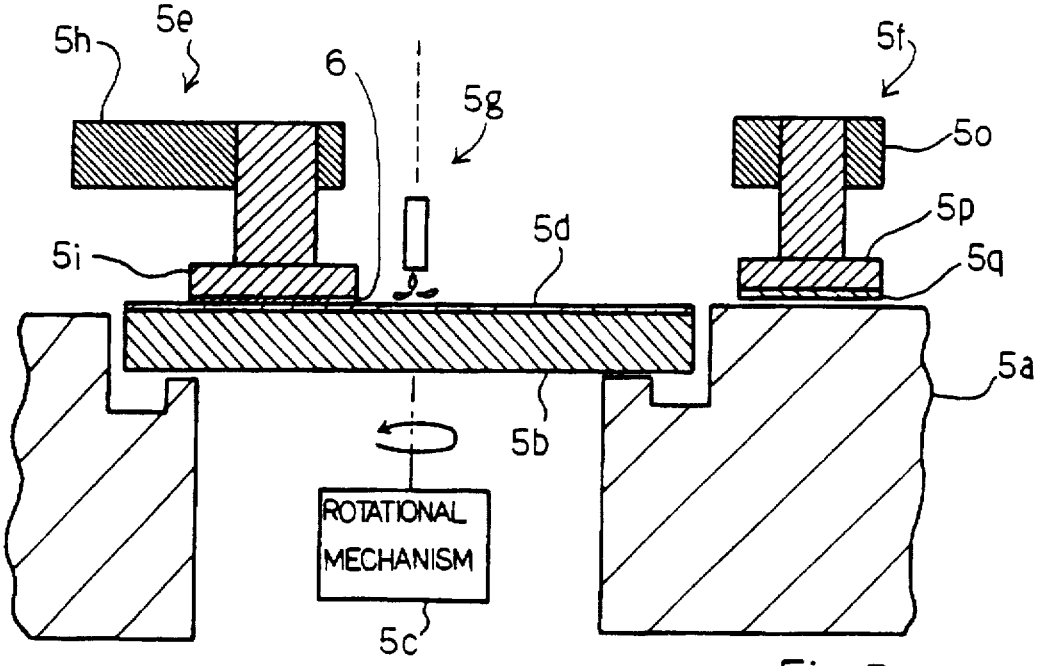
Fig. 3 PRIOR ART
FIG. 3 is a cross sectional view showing the structure of the prior art polishing apparatus in the polishing work.
Figure 4:
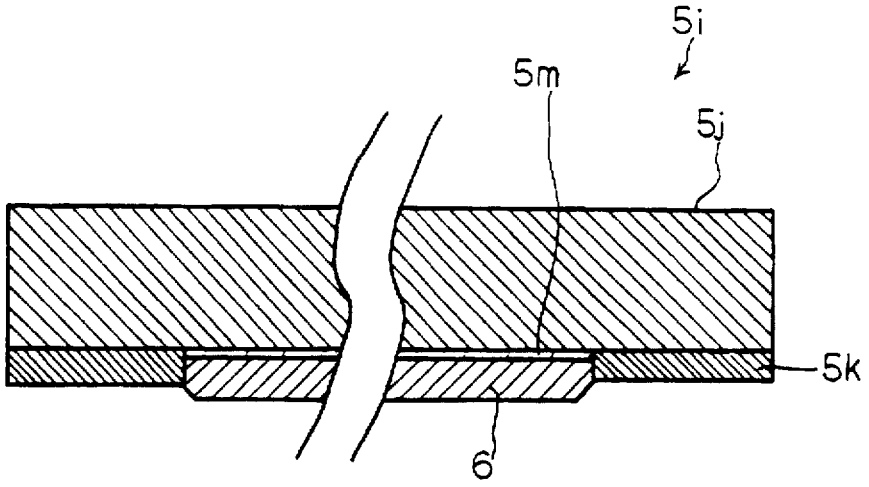
Fig. 4 PRIOR ART
FIG. 4 is a cross sectional view showing the retainer incorporated in the prior art polishing apparatus.
Figure 5:
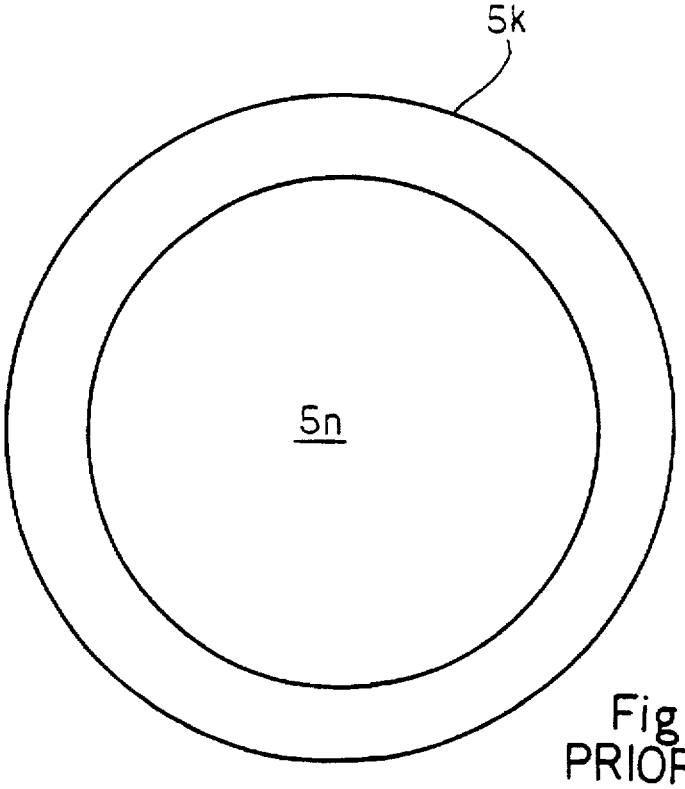
Fig. 5 PRIOR ART
FIG. 5 is a plan view showing the retainer.
Figure 6:
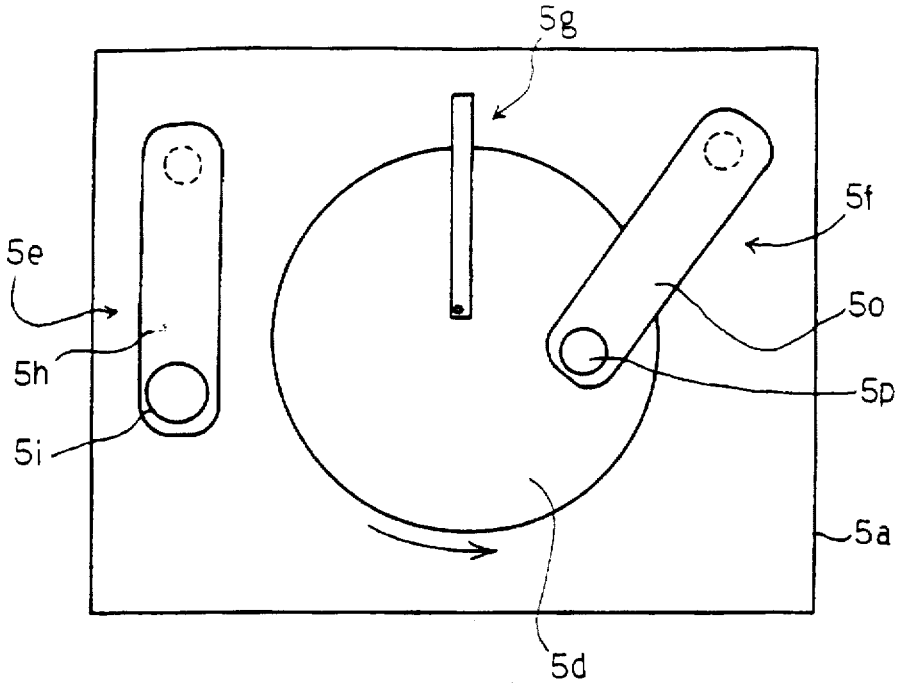
Fig·6 PRIOR ART
FIG. 6 is a plan view showing the prior art polishing apparatus in the conditioning work.
Figure 7:
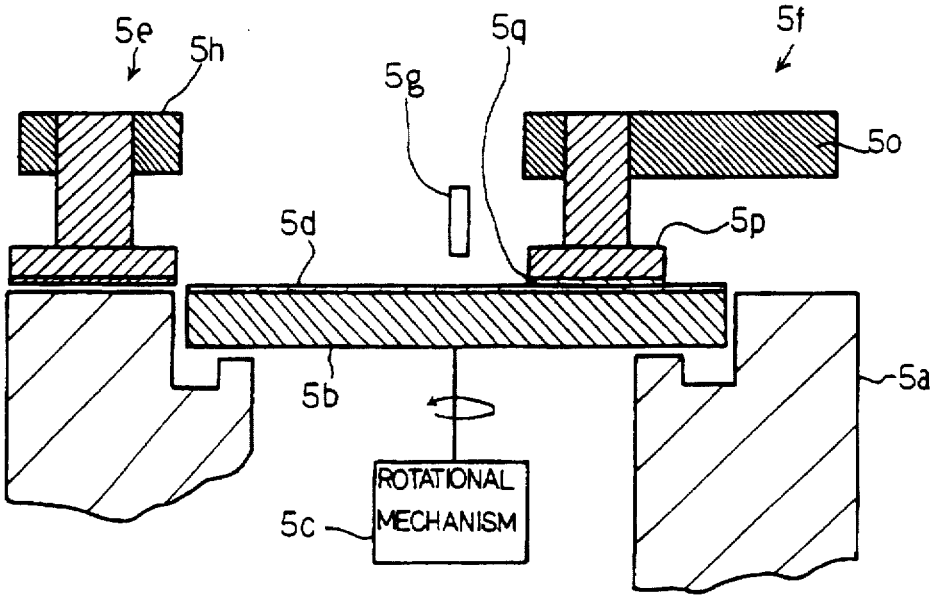
Fig·7 PRIOR ART
FIG. 7 is a cross sectional view showing the prior art polishing apparatus in the conditioning work.
Figure 8:
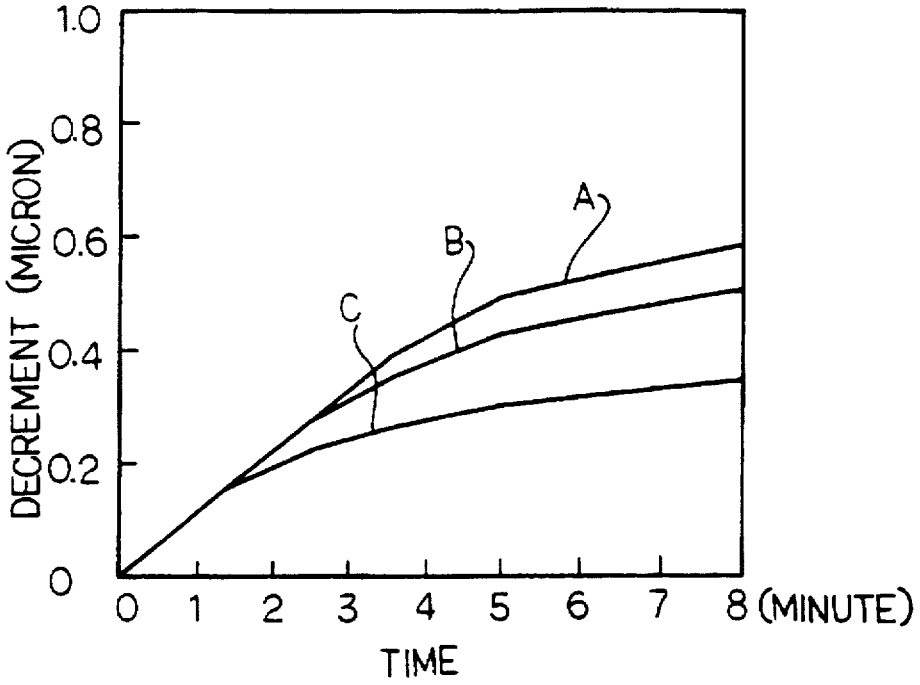
Fig·8 PRIOR ART
FIG. 8 is a graph showing the polishing rate in terms of the number of semiconductor wafers simultaneously polished on the same polishing pad.
Figure 9:
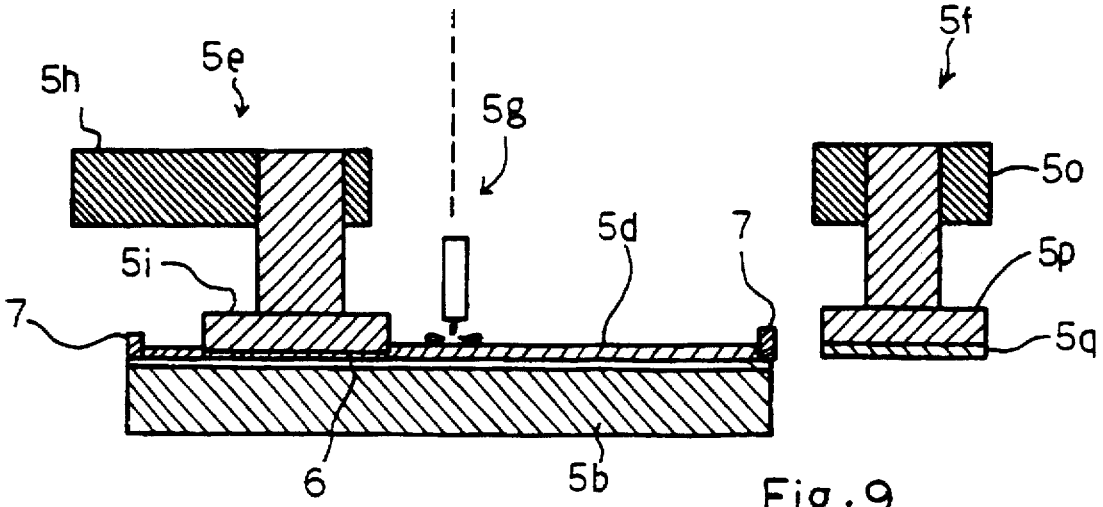
Fig·9 PRIOR ART
FIG. 9 is a cross sectional view showing the structure of the modification of the prior art polishing apparatus.
Figure 10:
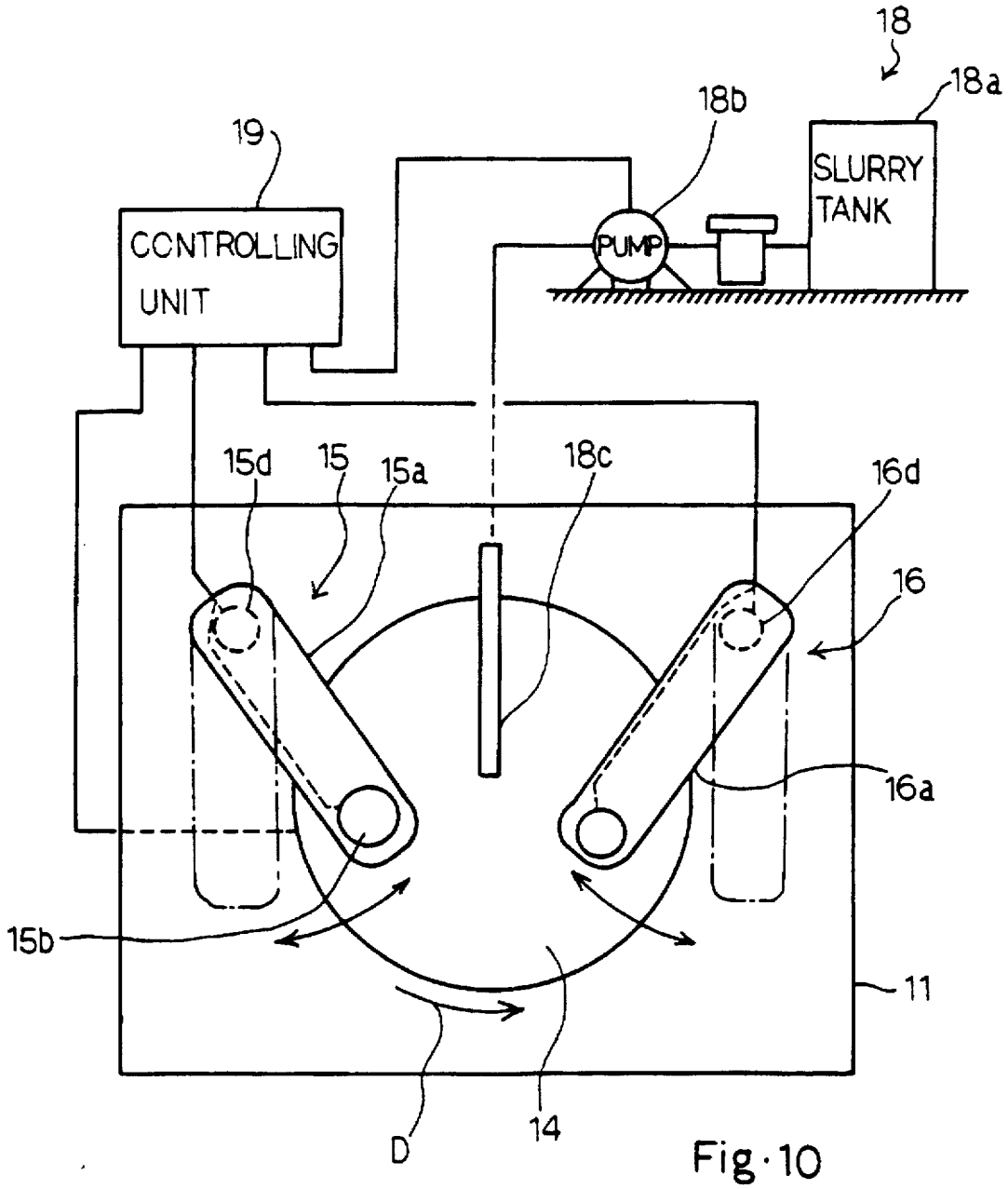
FIG. 10 is a schematic view showing a polishing apparatus according to the present invention.
Figure 11:
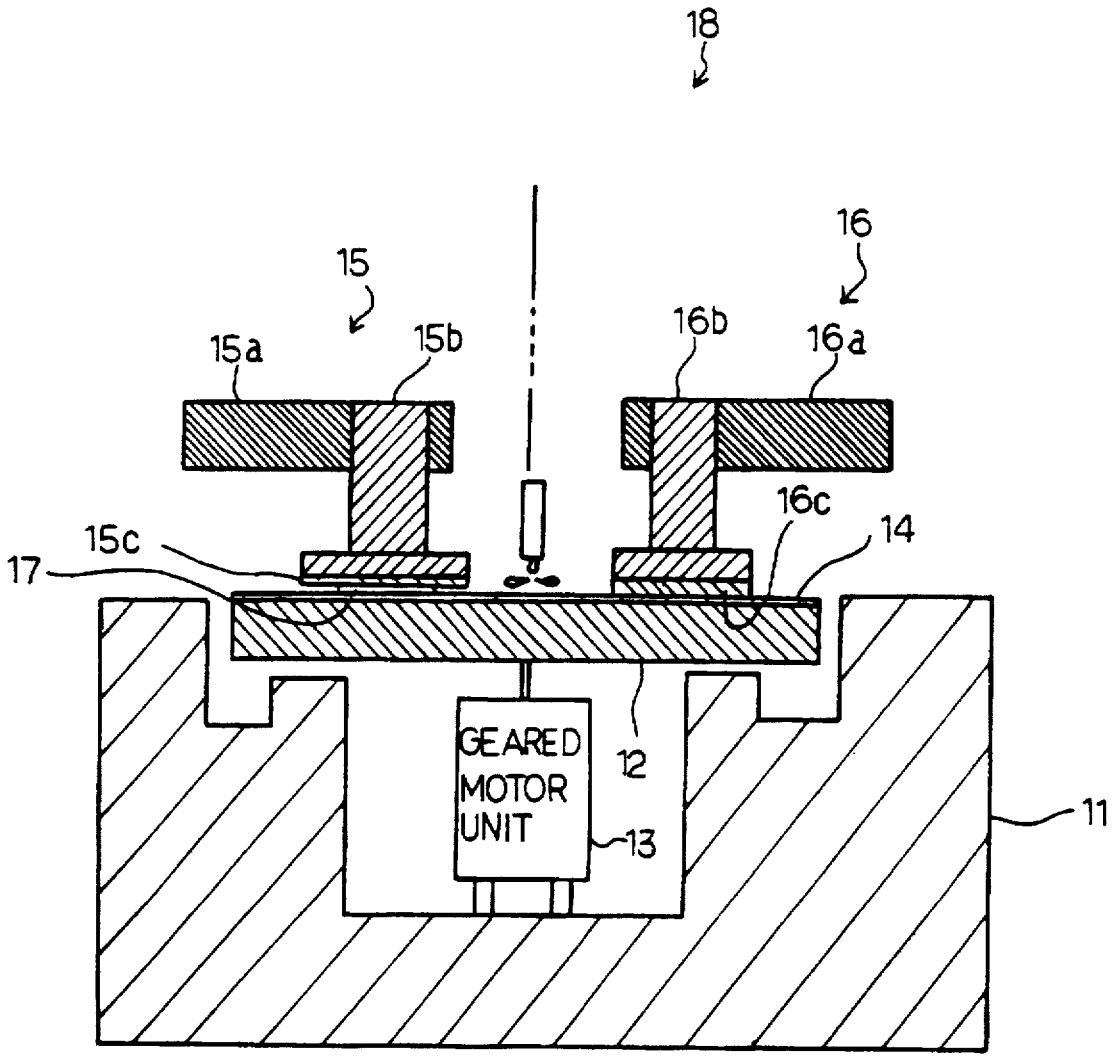
FIG. 11 is a cross sectional view showing the polishing apparatus according to the present invention.
Figure 12:
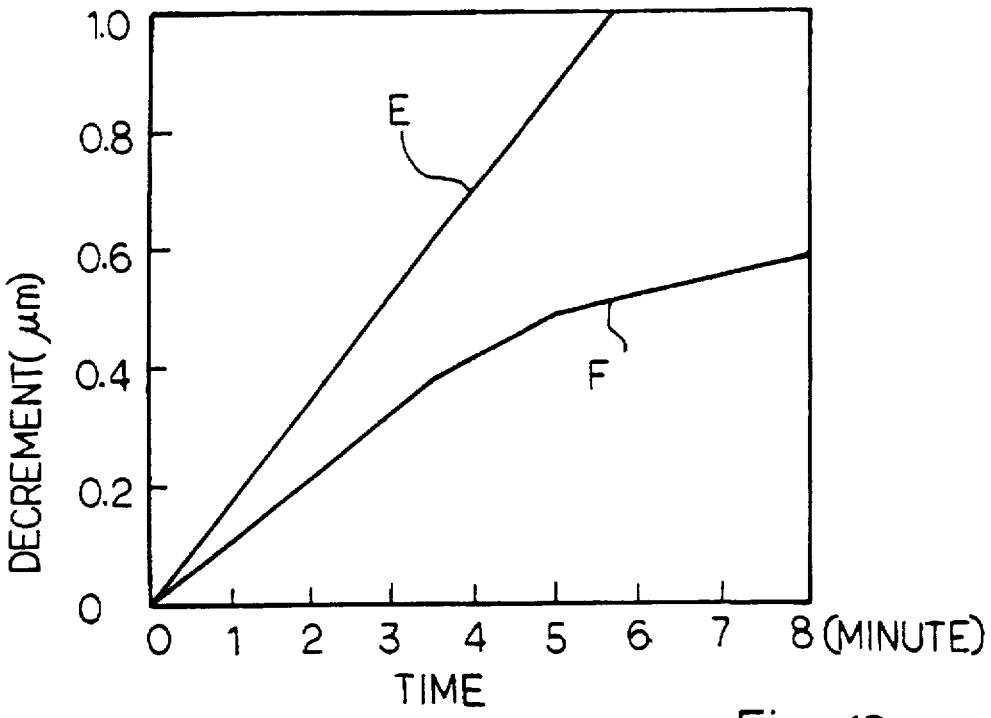
FIG. 12 is a graph showing the decrement of a semiconductor wafer in terms of time.

Referring to FIGS. 10 and 11 of the drawings, a polishing apparatus embodying the present invention comprises a frame work 11, a table 12 rotatable with respect to the frame work 11, a geared motor unit 13 connected to the table 12 and a polishing pad 14 covering the upper surface of the table 12. The geared motor unit 13 drives the table 12 for rotation, and the table 12 and the polishing pad 14 are rotated as indicated by an arrow D in FIG. 10. In this instance, the polishing pad is mainly formed from urethane. However, an artificial fabric is available for the polishing pad 14.

The polishing apparatus embodying the present invention further comprises a wafer holder system 15 and a pad conditioning system 16. The wafer holder system 15 detachably supports the semiconductor wafer 17 on the polishing pad 14, and the pad conditioning system 16 recovers the polishing pad 14 from loading or grinded powder on the polishing pad 14. According to the present invention, while the wafer holder system 15 is causing the semiconductor wafer 17 to be subjected to the polishing on the pad 14, the pad conditioning system is concurrently cleaning the polishing pad 14.

The wafer holder system 15 has an arm member 15*a*, a carrier block 15*b* and a retainer ring 15*c*. The arm member 15*a* is connected to a motor unit (not shown), and the motor unit causes the arm member 15*a* to turn around a post member 15*d*. The carrier block 15*b* downwardly projects from the leading end of the arm member 15*a*, and is associated with motor units (not shown). One of the motor units downwardly moves the carrier block 15*b*, and presses the semiconductor wafer 17 against the polishing pad 14. The other motor unit rotates the carrier block/the retainer 15*b*/15*c* and, accordingly, the semiconductor wafer 17 on the polishing pad 14. The retainer ring 15*c* is fixed to the carrier block 15*b*, and retains a semiconductor wafer 17. The retainer 15*d* is shaped into a ring configuration, and the semiconductor wafer 17 projects from an central opening of the retainer ring 15*d* by the standard value. The standard value is dependent on the wafer size, and 200 microns is the standard value for a 6-inch semiconductor wafer as described hereinbefore. The semiconductor wafer 17 retained between the carrier block 15*b* and the retainer 15*c* is stable in the polishing.

The wafer holder system 15 thus arranged is changeable between a rest position and a working position. In the rest position, the wafer holder system 15 causes the carrier block 15*b* and the retainer ring 15*c* to stay over the frame work 11 as indicative by dot-and-dash line in FIG. 10, and an operator can change the semiconductor wafer 17 to a new one. On the other hand, the wafer holder system 15 presses the semiconductor wafer 17 against the polishing pad 14 in the working position.

The pad conditioning system 16 has an arm member 16*a*, a carrier block 16*b* and a cleaner 16*c*. The arm member 16*a* is connected to a motor unit (not shown), and the motor unit causes the arm member 16*a* to turn around a post member 16*d*. The carrier block 16*b* downwardly projects from the leading end of the arm member 16*a*, and the cleaner 16*c* is electro-magnetically attached to the lower surface of the carrier block 16*b*. In this instance, the cleaner 16*c* is implemented by a diamond pellet. However, a wire brush, an appropriate metal and a ceramic pellet are available for the cleaner 16*c*. The carrier block 16*b* is associated with motor units (not shown). One of the motor units downwardly moves the carrier block 16*b*, and lightly presses the cleaner 16*c* against the polishing pad 14. The other motor unit rotates the cleaner 16*c* on the polishing pad 14.

The polishing apparatus embodying the present invention further comprises a slurry supply system 18 and a controlling unit 19. The slurry supply system 18 supplies polishing slurry to the polishing pad 14, and aids to grind a surface of the semiconductor wafer 17 in cooperation with the rotating polishing pad 14. Namely, the slurry supply system 18 comprises a slurry tank 18*a* for reserving the polishing slurry, a slurry pump unit 18*b* connected to the slurry tank 18*a* for pressurizing the polishing slurry and a slurry feed nozzle 18*c* for guiding the pressurized polishing slurry to the polishing pad 14. The slurry feed nozzle 18*c* is open at a center of the polishing pad 14, and centrifugal force due to the rotation of the polishing pad 14 spreads the polishing slurry over the polishing pad 14.

The controlling unit 19 is electrically connected to the geared motor unit 13, the motor units (not shown) associated with the wafer holder system 15, the motor units (not shown) associated with the pad conditioning system 16 and the slurry pump unit 18*b*. Though not shown in the drawings, a switch board is provided for the controlling unit 19, and the controlling unit 19 is responsive to instructions of an operator.

The controlling unit 19 causes both wafer holder and pad conditioning systems 15 and 16 to concurrently enter into the working positions, and the polishing pad 14 carries out the polishing work on the semiconductor wafer 17 under the concurrent clearing work with the cleaner 16*c*.

The present inventor evaluated the polishing apparatus embodying the present invention. Namely, the present inventor regulated the rotation of the polishing pad 5*d*/14, the rotation of the semiconductor wafer 6/17 and the pressure exerted to the semiconductor wafer 6/17 to 20 r.p.m., 30 r.p.m. and 0.5 Kg/cm$^2$, and measured the decrement of the semiconductor wafers 6/17 in terms of time. The decrement on the polishing apparatus shown in FIGS. 10 and 11 was plotted on line E, and the decrement on the prior art polishing apparatus was plotted on line F. Comparing Plots E with Plots F, it is understood that the concurrent cleaning work keeps the polishing rate constant, and the polishing rate of the polishing apparatus shown in FIGS. 10 and 11 is 1.5 times higher than the polishing rate of the prior art polishing apparatus.

Although the loading or the grinded powder impedes a uniform polishing, the concurrent cleaning work promotes the uniform polishing work, and the uniform polishing is achieved. In fact, the semiconductor wafer polished by the prior art polishing apparatus had the ununiformity of the order of 3 sigma=15 per cent. However, the polishing apparatus embodying the present invention improved the 3 sigma to 5 per cent.

As will be appreciated from the foregoing description, the present invention enhances the polishing rate and, accordingly, the throughput by virtue of the concurrent cleaning work.

Second Embodiment

Figure 13:
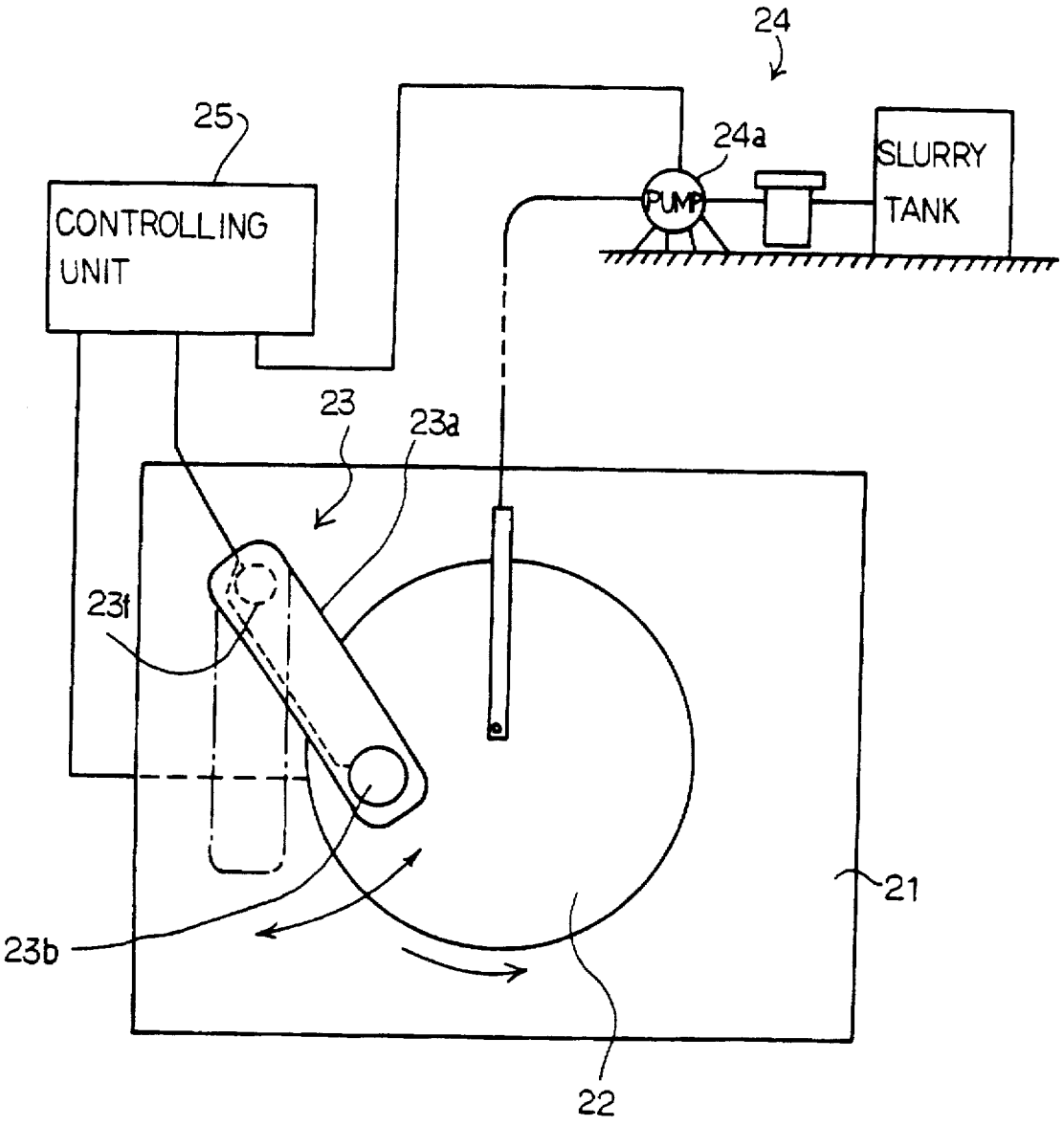
FIG. 13 is a schematic view showing another polishing apparatus according to the present invention.

Turning to FIG. 13 of the drawings, another polishing apparatus embodying the present invention largely comprises a frame work 21, a rotatable table covered with a polishing pad 22, a combined system 23 turnable between a rest position and a working position, a slurry supply system 24 and a controlling unit 25. The frame work 21, the rotatable table, the polishing pad 22 and the slurry supply system 24 are similar to those of the first embodiment, and description is not incorporated hereinbefore for avoiding repetition.

The wafer holder system 15 and the pad conditioning system 16 are replaced with the combined system 23, and the combined system not only supports a semiconductor wafer 26 on the polishing pad 22 but also concurrently carries out a cleaning on the polishing pad 22.

Figure 14:
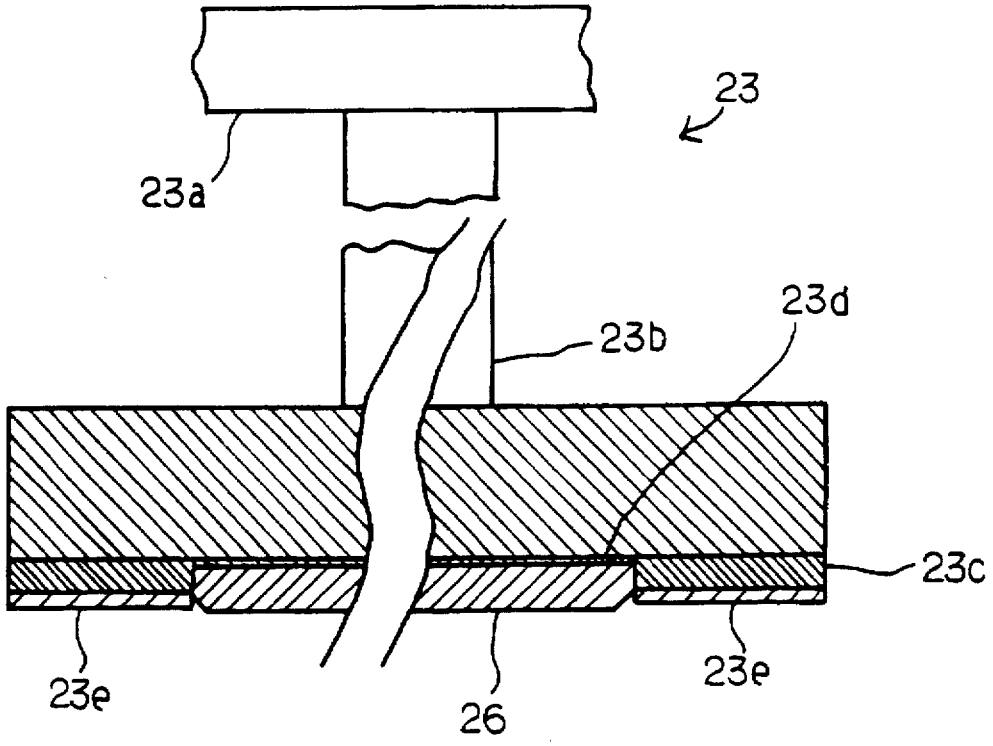
FIG. 14 is a partially cross sectional view showing a carrier block and a retainer ring incorporated in the polishing apparatus shown in FIG. 13.

As will be seen from FIG. 14, the combined system 23 comprises an arm member 23*a*, a carrier block 23*b* downwardly projecting from the leading end of the arm member 23*a*, a retainer ring 23*c* attached to the lower surface of the carrier block 23*b* for sandwiching the semiconductor wafer 26 therebetween, a pad member 23*d* inserted between the carrier block 23*b* and the semiconductor wafer 26 and cleaners 23*e* electromagnetically attached to the lower surface of the retainer ring 23*c*. In this instance, the pad member 23*d* is regulated such that the semiconductor wafer 25 projects from the retainer ring 23*c* by 50 microns. In this instance, the cleaners 23*e* are diamond pellets. However, a wire brush, an appropriate metal pellet and a ceramic pellet are available for the cleaners 23*e*.

Though not shown in FIGS. 13 and 14, the rotatable table is connected to a rotating mechanism, and the combined system 23 are associated with motor units. One of the motor unit causes the arm member 23*a* to turn around a post member 23*f*, and another motor unit downwardly move the carrier block 23*b* for pressing the semiconductor wafer 26 and the cleaner 23*e* against the polishing pad 22. Yet another motor unit rotates the carrier block 23*b* and, accordingly, the semiconductor wafer 26 and the cleaners 23*e* on the polishing pad 22.

The controlling unit 25 is electrically connected to a switch board (not shown), the motor units (not shown) associated with the rotatable table and the combined system 23 and the slurry pump unit 24*a* of the slurry supply system 24. Since both retainer ring 23*c* and cleaners 23*e* are carried by the arm member 23*a*, the retainer ring 23*c* and the cleaners 23*e* concurrently enter into the working position, and the polishing pad 22 carries out the polishing under a concurrent cleaning work.

Therefore, the polishing apparatus implementing the second embodiment achieves the advantages of the first embodiment, and is simpler in the structure than the first embodiment.

Figure 15A:
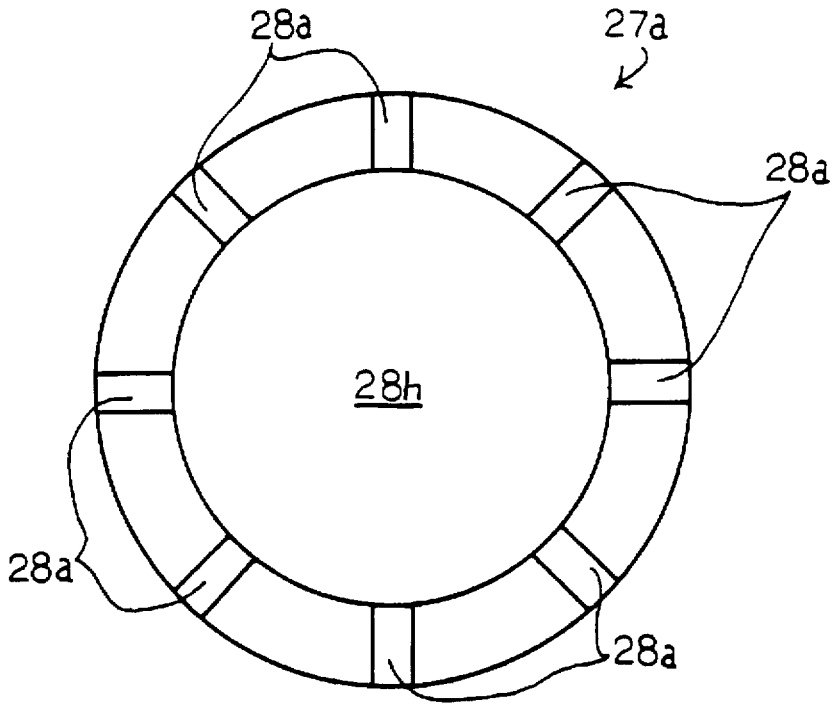
FIGS. 15A to 15C are plan views showing retainer rings available for the polishing apparatus according to the present invention.
Figure 15B:
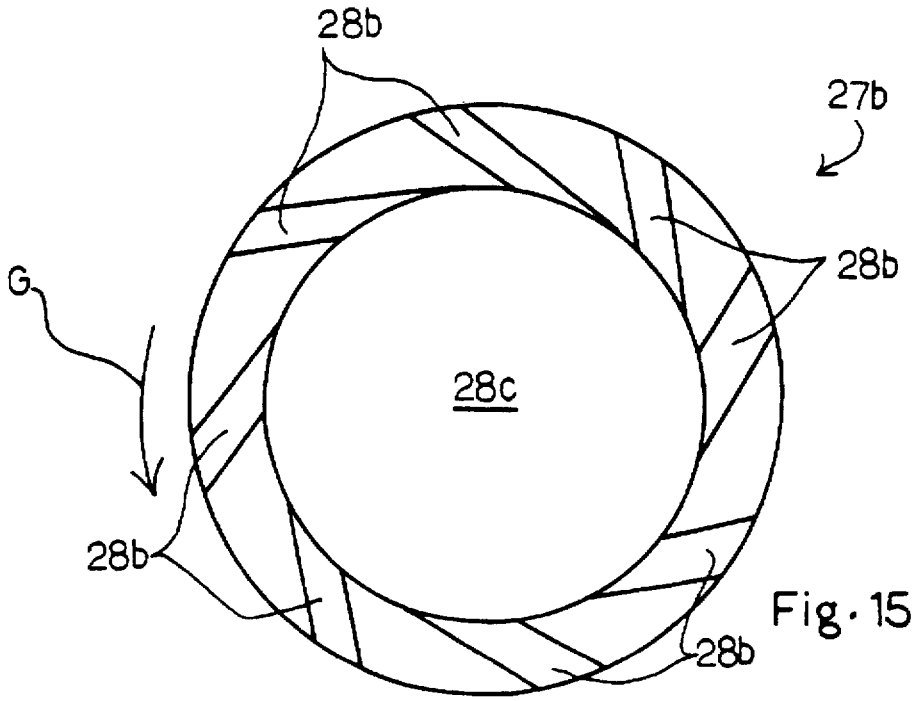
Figure 15C:
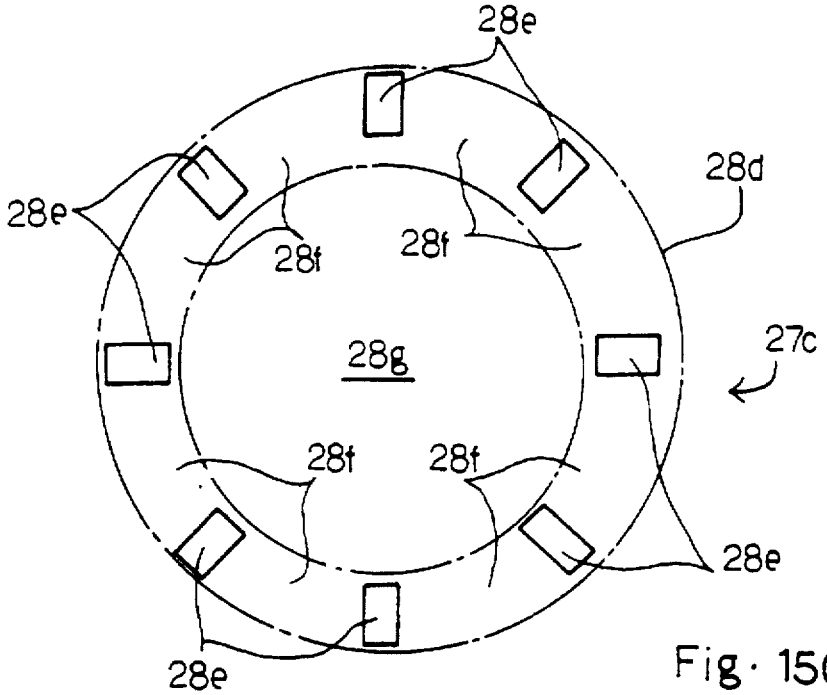

Each of the retainer rings 15*c* and 23*c* is replaceable with one of the retainer rings 27*a*, 27*b* and 27*c* shown in FIGS. 15A, 15B and 15C. The retainer ring 27*a* is partially cut away so as to form radial grooves 28*a*, and the polishing slurry flows through the radial grooves 28*a* toward the semiconductor wafer 26 exposed to a center opening 28*h*.

Similarly, the retainer ring 27*b* is also partially cut away, and tangential grooves 28*b* are formed in the retainer ring 27*b*. The grooves 28*b* extend in tangential directions of the retainer ring 27*b*. When the retainer ring 27*b* is rotated in a direction indicated by an arrow G, the tangential grooves 28*b* forces the polishing slurry to flow therethrough toward a center opening 28*c* where the semiconductor wafer 26 is exposed.

The retainer ring 27*c* comprises a base ring plate 28*d* and blocks 28*e* fixed to the base ring plate 28*d*. The blocks 28*e* are angularly spaced, and a channel 28*f* takes place between every adjacent two blocks 28*e*. The polishing slurry flows through the channels 28*f*, and reaches a central opening 28*g* where the semiconductor wafer 26 is exposed. The channels 28*f* are also called as "grooves".

If the retainer ring 15*c* or 23*c* is replaced with the retainer ring 27*a*, 27*b* or 27*c* with the grooves, the polishing slurry is sufficiently supplied through the grooves to the semiconductor wafer 26, and the polishing uniformity is further improved. Moreover, it is possible to increase the width of the retainer ring 27*a*, 27*b* or 27*c* by virtue of the grooves, and the retainer rings 27*a* to 27*c* are large in mechanical strength. For this reason, the retainer rings 27*a* to 27*c* is prolonged in service life. Even though the projection of the semiconductor wafer is decreased, the polishing slurry is sufficiently supplied through the grooves, and the retainer rings 27*a* to 27*c* withstand the polishing pad.

If the retainer ring 27*a*, 27*b* or 27*c* is used in the polishing apparatus implementing the first embodiment, a cleaner is not attached to the retainer ring 27*a*, 27*b* or 27*c*. However, if the retainer ring 27*a*, 27*b* or 27*c* is used in the polishing apparatus implementing the second embodiment, the cleaner 23*e* is attached to the retainer ring 27*a*, 27*b* or 27*c* between the grooves.

Third Embodiment

Figure 16:
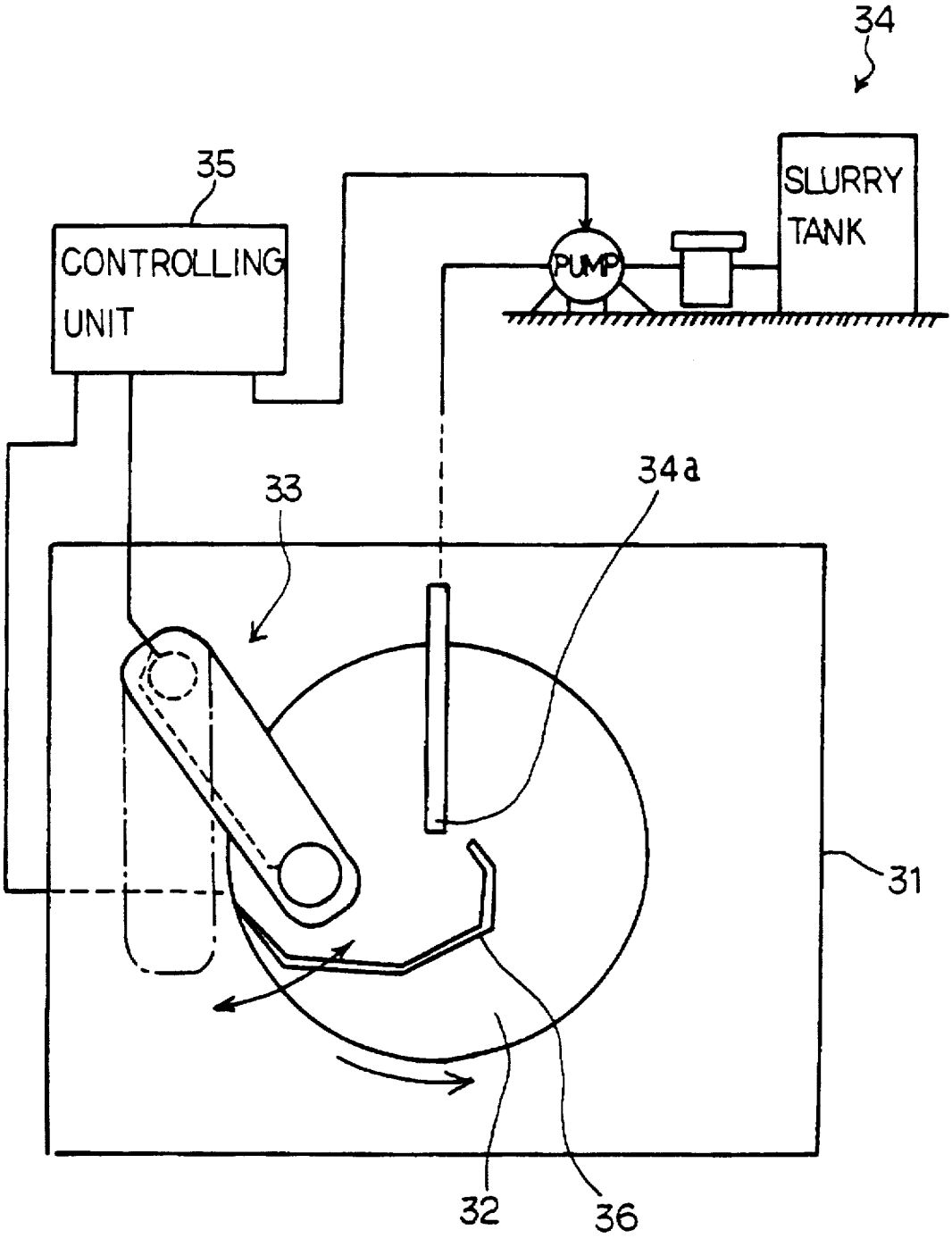
FIG. 16 is a schematic view showing yet another polishing apparatus according to the present invention.

Turning to FIG. 16 of the drawings, yet another polishing apparatus embodying the present invention largely comprises a frame work 31, a rotatable table (not shown) covered with a polishing pad 32, a combined system 33, a supply system 34, a controller 35 and a guide wall 36. The frame work 31, the rotatable table (not shown), the polishing pad 32, the combined system 33, the slurry supplying system 34 and the controlling unit 34 are similar to those of the second embodiment, and are not hereinbelow described in detail. The retainer rings 27*a* to 27*c* are also available for the combined system 33.

The guide wall 36 is supported by the frame work 31, and is stationary with respect to the frame work 31. The guide wall 36 may have a diamond pellet, a metal plate or a ceramics plate attached to the lower portion thereof. The lower edge of the guide wall 36 or the schooner is held in contact with the polishing pad 32, and the polishing pad 32 is rubbing against the lower edge of the guide wall 36 in the rotation. The guide wall 36 extends from the outer periphery of the polishing pad 32 to the central area around the slurry feed nozzle 34*a*, and guides the polishing slurry to return to the central area of the polishing pad 32. For this reason, part of the polishing slurry is repeatedly used in the polishing work, and the slurry supply system 34 only makes up the polishing slurry flowing out from the outer periphery of the polishing pad 32. Although the guide wall 36 is bent four times, a guide wall may extend straight or spiral. The guide wall 36 does not encircle the polishing pad 32, and the polishing slurry partially returns and partially flows out. For this reason, the polishing slurry supplied to the semiconductor wafer is not deteriorated.

The polishing apparatus implementing the third embodiment has the combined system 33. However, the combined system 33 is replaceable with the wafer holder system 15 and the pad conditioning system 16. If so, it is equivalent to the polishing apparatus shown in FIGS. 10 and 11 newly equipped with the guide wall 36.

Figure 17:
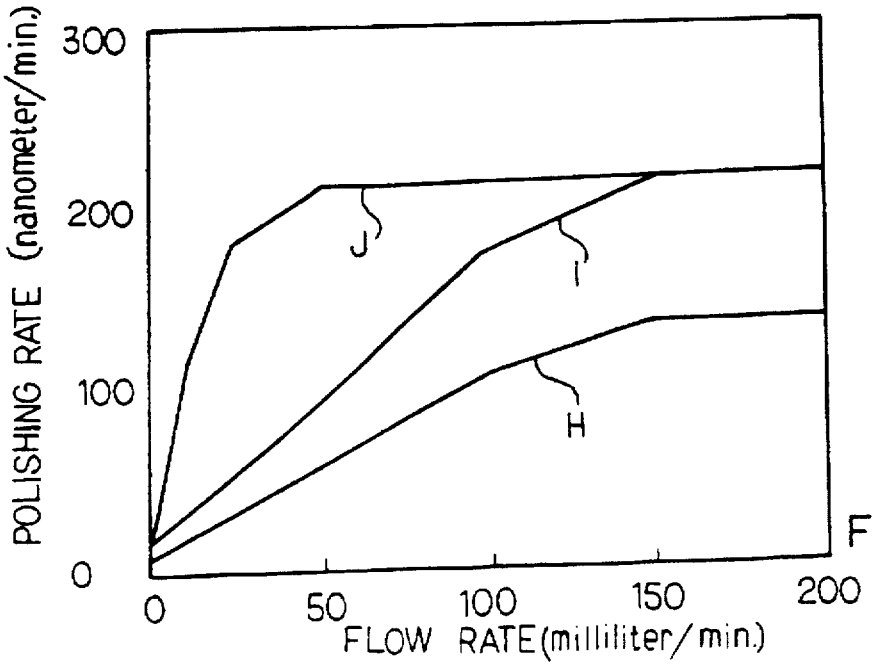
FIG. 17 is a graph showing the polishing rates in terms of the flow rate of a polishing slurry.

The present inventor evaluated the polishing apparatus implementing the third embodiment. Namely, the present inventor plotted the polishing rates in terms of the flow rate of the polishing slurry supplied from the slurry feed nozzle, as shown in FIG. 17. Plots H is representative of the experimental result that can be achieved when using the prior art polishing apparatus, and Plots I and J are indicative of the experimental results which can be achieved when using the first and third embodiments, respectively. When the flow rate was decreased to or below 150 milliliter per minute, the polishing rate of the prior art polishing apparatus was decreased. However, the polishing apparatus implementing the third embodiment keeps the polishing rate constant until the flow rate of about 50 milliliter per minutes by virtue of the guide wall 36.

Although particular embodiments of the present invention have been shown and described, it will be obvious to those skilled in the art that various changes and modifications may be made without departing from the spirit and scope of the present invention. For example, the polishing apparatus according to the present invention is available for a final stage of wafer preparation before the fabrication process of an integrated circuit device. A polishing apparatus according to the present invention may concurrently polish more than one semiconductor wafer.

What is claimed is:

1. A polishing apparatus for grinding a semiconductor wafer, comprising:

a table driven for rotation;

a polishing pad provided on a surface of said table that rotates together with said table;

a slurry supplying system provided over said polishing pad for supplying a polishing slurry thereto;

a wafer holder system retaining at least one semiconductor wafer for pressing a surface of said at least one semiconductor wafer against said polishing pad; and a pad conditioning system operative to clean said polishing pad while said semiconductor wafer is being polished on said polishing pad;

wherein said wafer holder system and said pad conditioning system are combined into a combined system which comprises:

a movable arm member;

a carrier block connected to said arm member and moved into and out of a space over said polishing pad;

a retainer retaining said at least one semiconductor wafer in cooperation with said carrier block and allowing said at least one semiconductor wafer to project therefrom; and a cleaner attached to said retainer;

said carrier block concurrently pressing said at least one semiconductor wafer and said cleaner against said polishing pad.

2. The polishing apparatus as set forth in claim 1, further comprising a controlling unit associated with said wafer holder system and said pad conditioning system and operative to concurrently change said wafer holder system and said pad conditioning system into respective working positions where said at least one semiconductor wafer is pressed against said polishing pad which is being subjected to the cleaning.

3. The polishing apparatus as set forth in claim 2, in which said wafer holder system rotates said at least one semiconductor wafer on said polishing pad.

4. The polishing apparatus as set forth in claim 1, in which said carrier block is driven for rotation so that said at least one semiconductor wafer and said cleaner turn on said polishing pad.

5. A polishing apparatus for grinding a semiconductor wafer, comprising:

a table driven for rotation;

a polishing pad provided on a surface of said table and rotating together with said table;

a slurry supplying system provided over said polishing pad for supplying a polishing slurry thereto; and a wafer holder system pressing a surface of at least one semiconductor wafer against said polishing pad, said wafer holder system having a carrier block and a retainer ring attached to said carrier block for retaining said at least one semiconductor wafer therebetween, said surface of said at least one semiconductor wafer projecting from an opening of said retainer ring so that said surface of said at least one semiconductor wafer can contact said polishing pad;

wherein at least one groove is formed in said retainer ring so as to supply said polishing slurry through said groove to said surface of said at least one semiconductor wafer;

wherein a cleaner is attached to the retainer ring so as to clean said polishing pad in a polishing work on said at least one semiconductor wafer.

6. The polishing apparatus as set forth in claim 5 further comprising a pad conditioning system operative to clean said polishing pad while said semiconductor wafer is being polished on said polishing pad.

7. The polishing apparatus as set forth in claim 5, in which said carrier block is driven for rotation so as to rotate said at least one semiconductor wafer and said cleaner on said polishing pad.

8. The polishing apparatus as set forth in claim 5, in which said groove radially extends in said retainer.

9. The polishing apparatus as set forth in claim 5, in which said groove extend in a tangential direction of said retainer ring, and said carrier block is driven for rotation so as to rotate said at least one semiconductor wafer and said retainer ring on said polishing pad.

10. A polishing apparatus for grinding a semiconductor wafer, comprising:

a table driven for rotation;

a polishing pad provided on a surface of said table and rotating together with said table;

a slurry supplying system provided over said polishing pad for supplying a polishing slurry thereto;

a wafer holder system retaining at least one semiconductor wafer for pressing a surface of said at least one semiconductor wafer against said polishing pad; and a guide member stationary with respect to said table and held in contact with said polishing pad for forcing a part of said polishing slurry to return from an outer periphery of said polishing pad to a center area of said polishing pad.

11. The polishing apparatus as set forth in claim 10, further comprising a pad conditioning system operative to clean said polishing pad while said semiconductor wafer is being polished on said polishing pad.

12. The polishing apparatus as set forth in claim 10, in which said wafer holder system comprises a carrier block and a retainer ring attached to said carrier block for retaining said at least one semiconductor wafer therebetween, said surface of said at least one semiconductor wafer projecting from an opening of said retainer ring so that said surface of said at least one semiconductor wafer can contact said polishing pad; wherein at least one groove is formed in said retainer ring so as to supply said polishing slurry through said groove to said surface of said at least one semiconductor wafer.

13. A polishing apparatus for grinding a semiconductor wafer, comprising:

a table driven for rotation;

a polishing pad provided on a surface of said table and rotating together with said table;

a slurry supplying system provided over said polishing pad for supplying a polishing slurry thereto;

a wafer holder system retaining at least one semiconductor wafer for pressing a surface of said at least one semiconductor wafer against said polishing pad; and a guide member stationary with respect to said table and held in contact with said polishing pad for forcing a part of said polishing slurry to return from an outer periphery of said polishing pad to a center area of said polishing pad;

wherein said wafer holder system comprises a carrier block and a retainer rind attached to said carrier block for retaining said at least one semiconductor wafer therebetween, said surface of said at least one semiconductor wafer projecting from an opening of said retainer ring so that said surface of said at least one semiconductor wafer can contact said polishing pad;

wherein at least one groove is formed in said retainer ring so as to supply said polishing slurry through said groove to said surface of said at least one semiconductor wafer; and wherein a cleaner is attached to the retainer ring so as to clean said polishing pad in a polishing work on said at least one semiconductor wafer.

14. The polishing apparatus as set forth in claim 13, in which said carrier block is driven for rotation so as to rotate said at least one semiconductor wafer and said cleaner on said polishing pad.

15. The polishing apparatus as set forth in claim 12, in which said groove radially extends in said retainer.

16. The polishing apparatus as set forth in claim 12, in which said groove extend in a tangential direction of said retainer ring, and said carrier block is driven for rotation so as to rotate said at least one semiconductor wafer and said cleaner on said polishing pad.

17. The polishing apparatus as set forth in claim 10, in which said guide member includes a portion which is held in contact with said polishing pad.

18. The polishing apparatus as set forth in claim 17, in which said portion is formed of a substance selected from the group consisting of diamond, metal and ceramics.

* * * * *